US008410382B2

(12) United States Patent
Yuasa

(10) Patent No.: US 8,410,382 B2
(45) Date of Patent: Apr. 2, 2013

(54) OPERATION PANEL DEVICE FOR AN ELEVATOR

(75) Inventor: Eiji Yuasa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 165 days.

(21) Appl. No.: 12/988,579

(22) PCT Filed: Jul. 10, 2008

(86) PCT No.: PCT/JP2008/062474

§ 371 (c)(1),
(2), (4) Date: Oct. 19, 2010

(87) PCT Pub. No.: WO2010/004631

PCT Pub. Date: Jan. 14, 2010

(65) Prior Publication Data

US 2011/0036692 A1 Feb. 17, 2011

(51) Int. Cl.
*H01H 9/00* (2006.01)

(52) U.S. Cl. ..... 200/296; 200/341

(58) Field of Classification Search ..... 200/293–296, 200/329–331, 341–345; 248/27.1, 27.3, 248/221.11–222.13, 225.11, 225.21, 226.11, 248/226.12, 227.1, 231.81; 428/99, 100; 174/66, 67; 187/395

See application file for complete search history.

(56) References Cited

U.S. PATENT DOCUMENTS

| | | | | |
|---|---|---|---|---|
| 4,919,369 | A * | 4/1990 | Stehn | 248/27.3 |
| 4,988,553 | A * | 1/1991 | Saiki et al. | 428/99 |
| 5,178,504 | A * | 1/1993 | Falchi | 411/553 |
| 5,217,190 | A * | 6/1993 | Reed et al. | 248/27.3 |
| 5,883,348 | A * | 3/1999 | Yokoyama | 200/61.54 |
| 6,600,118 | B2 * | 7/2003 | Altmann | 200/295 |
| 7,253,370 | B2 * | 8/2007 | Chen et al. | 200/341 |
| 2006/0131149 | A1 * | 6/2006 | Mattarelli | 200/329 |

FOREIGN PATENT DOCUMENTS

| | | |
|---|---|---|
| CN | 1129844 A | 8/1996 |
| JP | 58-187199 U | 12/1983 |
| JP | 61-59388 U | 4/1986 |
| JP | 62 15727 | 1/1987 |
| JP | 1 83231 | 6/1989 |
| JP | 05-27314 U | 4/1993 |
| JP | 2000 302345 | 10/2000 |
| JP | 2006 331809 | 12/2006 |

OTHER PUBLICATIONS

International Search Report issued Apr. 7, 2009 in PCT/JP08/062474 filed Jul. 10, 2008.
Office Action issued Dec. 4, 2012 in Japanese Patent Application No. 2010-519594 (with English Translation).
Office Action issued Nov. 26, 2012 in Chinese Patent Application No. 200880129557.8 (with English Translation).

* cited by examiner

*Primary Examiner* — Michael Friedhofer
(74) *Attorney, Agent, or Firm* — Oblon, Spivak, McClelland, Maier & Neustadt, L.L.P.

(57) ABSTRACT

In an operation panel device for an elevator, a switch provided with a switch main body and an operation portion is mounted onto the back surface of a faceplate. A retaining mechanism for retaining the switch main body in a predetermined mounting position is provided between a side surface of the switch main body and the back surface of the faceplate. The retaining mechanism includes an elastic member. The elastic member allows the switch main body to be moved to the mounting position by elastic deformation. Further, when the switch main body is moved to the mounting position, the elastic member is restored to an original state thereof to prevent the switch main body from moving from the mounting position.

8 Claims, 7 Drawing Sheets

OPERATION PANEL DEVICE FOR AN ELEVATOR

TECHNICAL FIELD

The present invention relates to an operation panel device for an elevator, which is used for, for example, a car operating panel or a landing button device.

BACKGROUND ART

A conventional operation panel for an elevator includes a flange portion and elastic claws, which are provided to an outer frame member of an operation button switch. The flange portion is engaged to an edge of an opening of a faceplate from the surface side. In addition, the elastic claws are engaged to the edge of the opening of the faceplate from the back surface side. With this structure, the operation button switch can be mounted onto the faceplate from the surface side of the faceplate with a single-touch operation (for example, see Patent Document 1).

Patent Document 1: JP 2000-302345 A

DISCLOSURE OF THE INVENTION

Problems to be Solved by the Invention

In the conventional operation button switch for the elevator as described above, the flange portion is provided to the outer frame member so as to enable the mounting with the single-touch operation. Therefore, it is necessary to provide the outer frame member, which is visible even from the surface side of the faceplate, around a press portion. Accordingly, the operation button switch is subjected to restrictions in terms of design. Moreover, for a conventional operation button switch which is mounted on the back surface side of the faceplate without using the outer frame member, a stud bolt fixed on the back surface of the faceplate is caused to penetrate through the switch so as to be fastened with a nut. Therefore, the mounting to the faceplate requires much effort.

The present invention has been made to solve the problems described above, and it is an object of the present invention to provide an operation panel device for an elevator, which is not required to be provided with an outer frame visible from the surface side of a faceplate around an operation portion, and therefore, provides ease in mounting a switch onto the faceplate.

Means for Solving the Problems

An operation panel device for an elevator according to the present invention includes: a faceplate having an opening portion; and a switch including : a switch main body mounted onto the faceplate; and an operation portion provided to the switch main body, the operation portion being exposed on a surface side of the faceplate through the opening portion, in which: a retaining mechanism for retaining the switch main body in a predetermined mounting position is provided between a side surface of the switch main body and a back surface of the faceplate; and the retaining mechanism includes an elastic member for allowing the switch main body to be moved to the mounting position by elastic deformation and for being restored to an original state to prevent the switch main body from moving from the mounting position when the switch main body is moved to the mounting position.

BEST MODE FOR CARRYING OUT THE INVENTION

Figure 1:
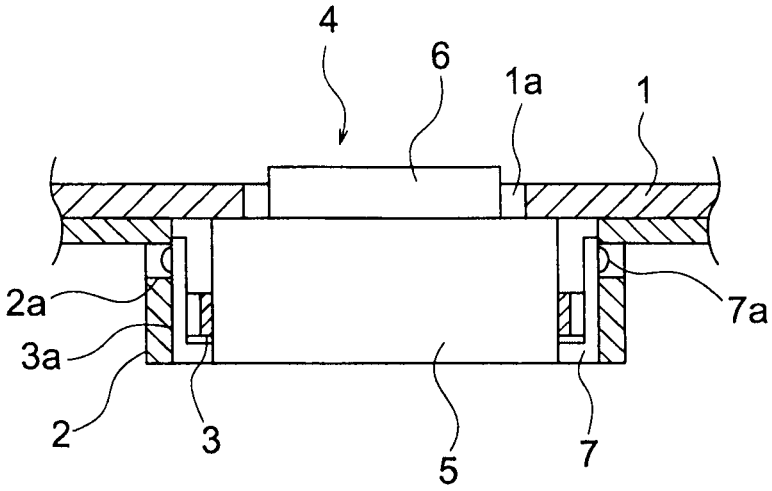
FIG. 1 is a sectional view illustrating a principal part of an operation panel device for an elevator, according to a first embodiment of the present invention.

Hereinafter, preferred embodiments of the present invention are described referring to the drawings.

First Embodiment

Figure 2:
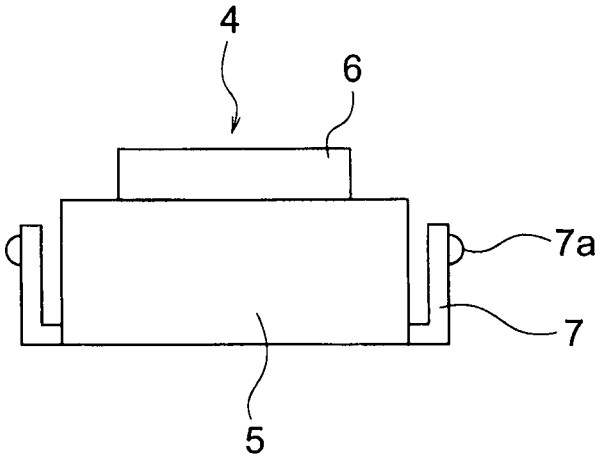
FIG. 2 is a side view illustrating a push-button switch illustrated in FIG. 1.
Figure 3:
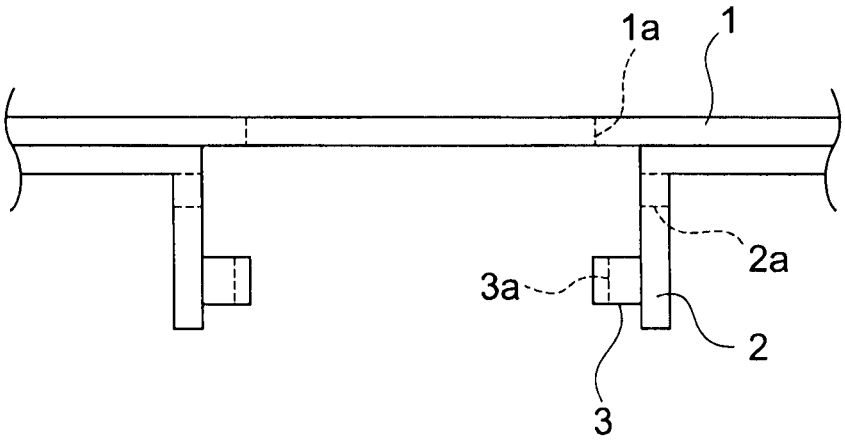
FIG. 3 is a side view illustrating a faceplate illustrated in FIG. 1.
Figure 4:
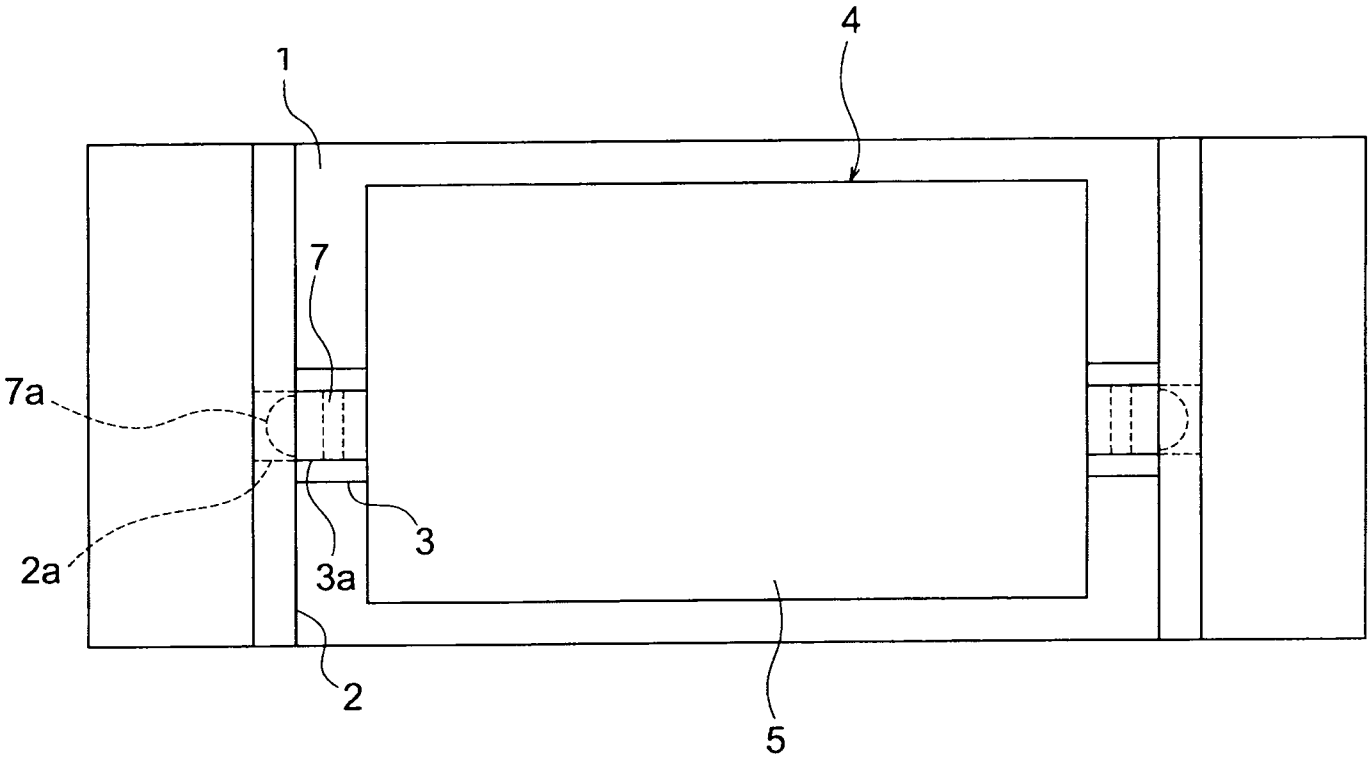
FIG. 4 is a back view illustrating a structure for mounting the push-button switch illustrated in FIG. 1.

FIG. 1 is a sectional view of a principal part of an operation panel device for an elevator, according to a first embodiment of the present invention. FIG. 2 is a side view illustrating a push-button switch illustrated in FIG. 1. FIG. 3 is a side view illustrating a faceplate illustrated in FIG. 1. FIG. 4 is a back view illustrating a structure for mounting the push-button switch illustrated in FIG. 1. Note that, in FIG. 1, only components on the faceplate side are illustrated in cross section, and a side view is illustrated for the push-button switch.

In the drawings, an opening portion 1*a* is provided through a faceplate 1. Onto a back surface of the faceplate 1, a pair of retaining members 2, each having an L-shaped cross section, are fixed. The retaining members 2 face each other with the opening portion 1*a* sandwiched therebetween. On surfaces of the retaining members 2, which are opposed to each other, slit-forming members 3, each for forming a slit 3*a* with a corresponding one of the retaining members 2, are respectively fixed.

A fitting hole 2*a* serving as a locking portion is provided to each of the retaining members 2. The fitting hole 2*a* is provided on the faceplate 1 side of the slit 3*a* so as to be adjacent thereto.

A push-button switch 4 is mounted between the retaining members 2 on the back surface of the faceplate 1. The push-button switch 4 includes a switch main body (a button base) 5 mounted onto the faceplate 1 and a press portion 6 serving as an operation portion provided to the switch main body 5. The press portion 6 is exposed on (projects from) the surface side of the faceplate 1 through the opening portion 1*a*.

Onto side surfaces of the switch main body 5, a pair of elastic members (levers) 7 serving as insertion members inserted into the slits 3*a* are fixed. The elastic members 7 are elastically deformable as in the case of a flat spring. A retaining projection 7*a* fitted into a corresponding one of the fitting holes 2*a* is provided to a distal end portion of each of the elastic members 7.

The elastic members 7 allow the switch main body 5 to move to a mounting position by elastic deformation. Moreover, when the switch main body 5 is moved to the mounting position, the elastic members 7 are restored to an original state thereof to fit the retaining projections 7*a* into the fitting holes 2*a* so as to prevent the switch main body 5 from being moved (removed) from the mounting position.

A size between the slit-forming members 3 on both sides of the switch main body 5 and a width size (a horizontal size illustrated in FIG. 1) of the switch main body 5 are approximately the same. The side surfaces of the switch main body 5 respectively abut against the slit-forming members 3. As a result, the switch main body 5 is positioned in the width direction to prevent the occurrence of backlash of the switch main body 5 in the width direction.

Moreover, a width size of each of the elastic members 7 and a width direction of each of the slits 3*a* are approximately the same . Both ends in the width direction of each of the elastic members 7 abut against an inner surface of a corresponding one of the slit-forming members 3. As a result, the switch main body 5 is positioned vertically (in a vertical direction of FIG. 4) to prevent the occurrence of vertical backlash of the switch main body 5.

A retaining mechanism for retaining the switch main body 5 to the mounting position includes the retaining members 2, each being provided with the fitting hole 2*a*, and the elastic members 7, each being provided with the retaining projection 7*a*. In addition, a positioning mechanism includes the retaining members 2, the slit-forming members 3, and the elastic members 7. The positioning mechanism guides the switch main body 5 in a direction perpendicular to the back surface of the faceplate 1 and positions the switch main body 5 in a direction parallel to the back surface of the faceplate 1, for mounting the switch main body 5 onto the faceplate 1.

In the operation panel device described above, the retaining mechanism is provided between the side surfaces of the switch main body 5 and the back surface of the faceplate 1. Therefore, an outer frame, which is visible from the surface (design surface) side of the faceplate 1, is not required to be provided around the press portion 6. Thus, the degree of freedom in design can be increased. Moreover, the push-button switch 4 can be easily mounted onto the rear side of the faceplate 1 with a single-touch operation because the retaining mechanism including the elastic members 7 is used.

Further, the retaining mechanism is provided between the side surfaces of the switch main body 5 and the faceplate 1. Therefore, a thickness of the operation panel device can be reduced as compared with a structure in which a switch support plate different from the faceplate 1 is mounted to the faceplate 1 after a rear end portion of the switch is mounted to the switch support plate with a single-touch mounting structure. Therefore, for example, in the case of a car operating panel provided on a cage wall, a thickness size of an installation space can be reduced to increase a space of the cage.

Further, the retaining mechanism including the retaining members 2, each being provided with the fitting hole 2*a*, and the elastic members 7, each being provided with the retaining projection 7*a*, is used. Therefore, the switch main body 5 can be retained in the mounting position with a simple structure. In addition, the switch main body 5 can be positioned in the direction perpendicular to the back surface of the faceplate 1.

Moreover, the positioning mechanism is provided between the side surfaces of the switch main body 5 and the back surface of the faceplate 1. Thus, the push-button switch 4 can be mounted onto the faceplate 1 with good accuracy while the thickness of the operation panel device is reduced.

Further, the positioning mechanism including the retaining members 2, the slit-forming members 3, and the elastic members 7 is used. Therefore, the switch main body 5 can be guided with the simple structure. In addition, the occurrence of backlash of the switch main body 5 can be prevented. Moreover, in the case where the switch main body 5 has a cylindrical shape, the positioning of the switch main body 5 in a circumferential direction can also be performed.

Further, the elastic members 7 constituting a part of the retaining mechanism also serve as the insertion members constituting apart of the positioning mechanism. Therefore, the configuration can be simplified.

Second Embodiment

Figure 5:
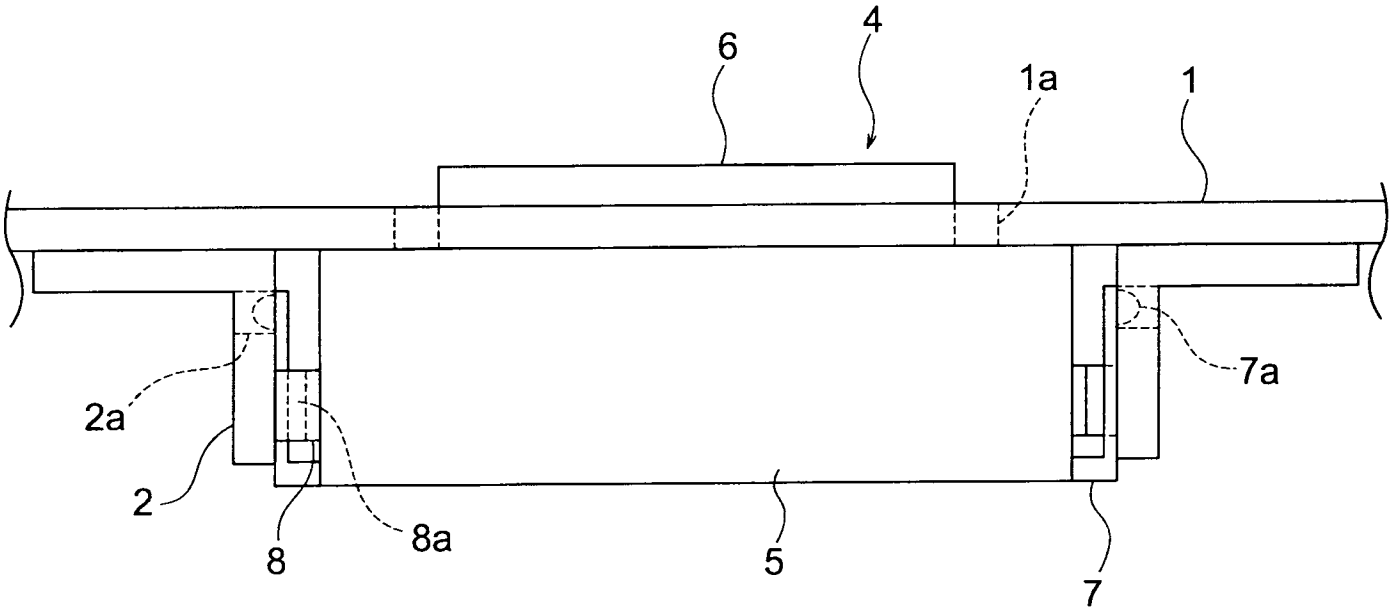
FIG. 5 is a side view illustrating a principal part of the operation panel device for the elevator, according to a second embodiment of the present invention.
Figure 6:
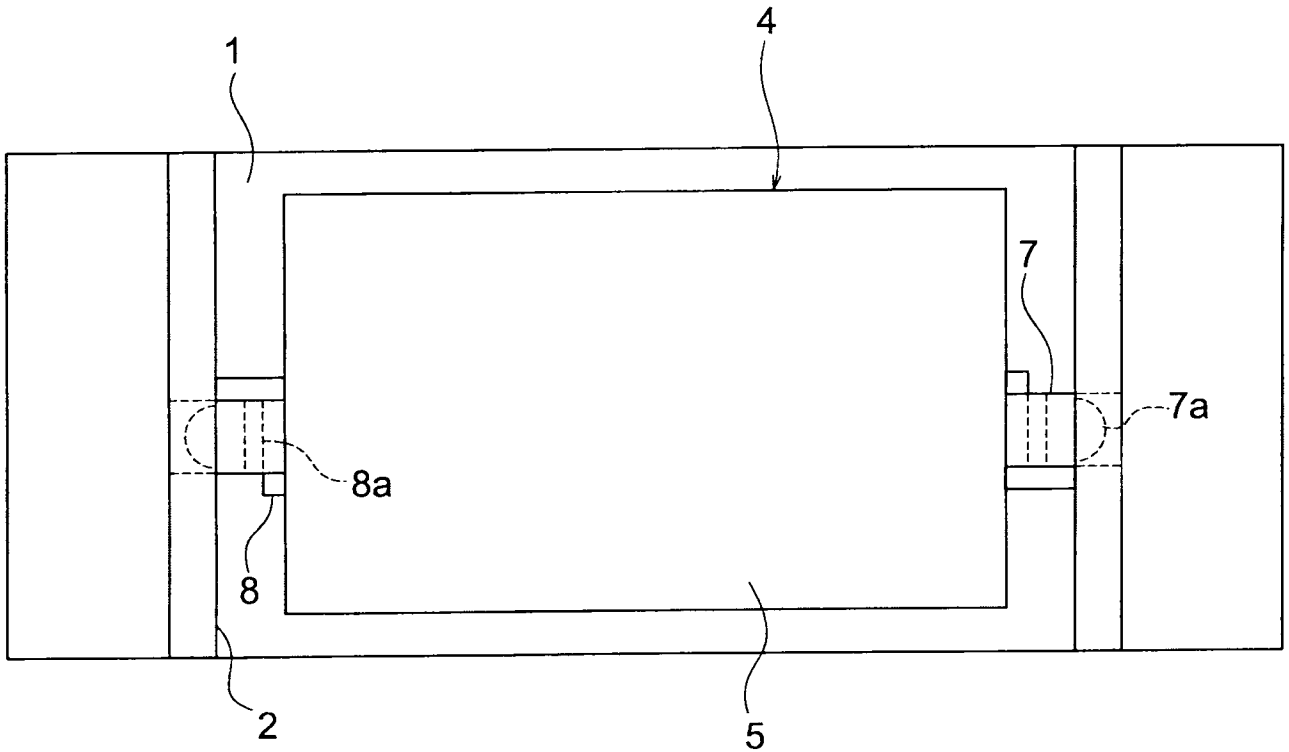
FIG. 6 is a back view illustrating the structure for mounting the push-button switch illustrated in FIG. 5.

Next, FIG. 5 is a side view illustrating a principal part of the operation panel device for the elevator, according to a second embodiment of the present invention, and FIG. 6 is a back view illustrating the structure for mounting the push-button switch illustrated in FIG. 5. In this example, a slit-forming member 8 having an L-shaped cross section is fixed to each of the retaining members 2. Each of the slit-forming members 8 forms a slit 8*a* having one open end in a width direction with a corresponding one of the retaining members 2. In addition, the slit-forming members 8 are arranged in opposite directions on the right and left of the switch main body 5 so that the open ends of the slits 8*a* are oriented in vertically opposite directions on the right and left of the switch main body 5. The remaining structure is the same as that of the first embodiment.

As described above, even by using the slit-forming members 8, each having a simplified shape, the outer frame visible from the surface side of the faceplate 1 is not required to be provided around the press portion 6. Moreover, the mounting of the push-button switch 4 onto the faceplate 1 can be facilitated.

Further, the slit-forming members 8 are arranged so as to be oriented in the opposite directions on the right and left of the switch main body 5. Thus, the occurrence of the vertical backlash of the switch main body 5 can be prevented with the slit-forming members 8, each having a simple shape.

Third Embodiment

Figure 7:
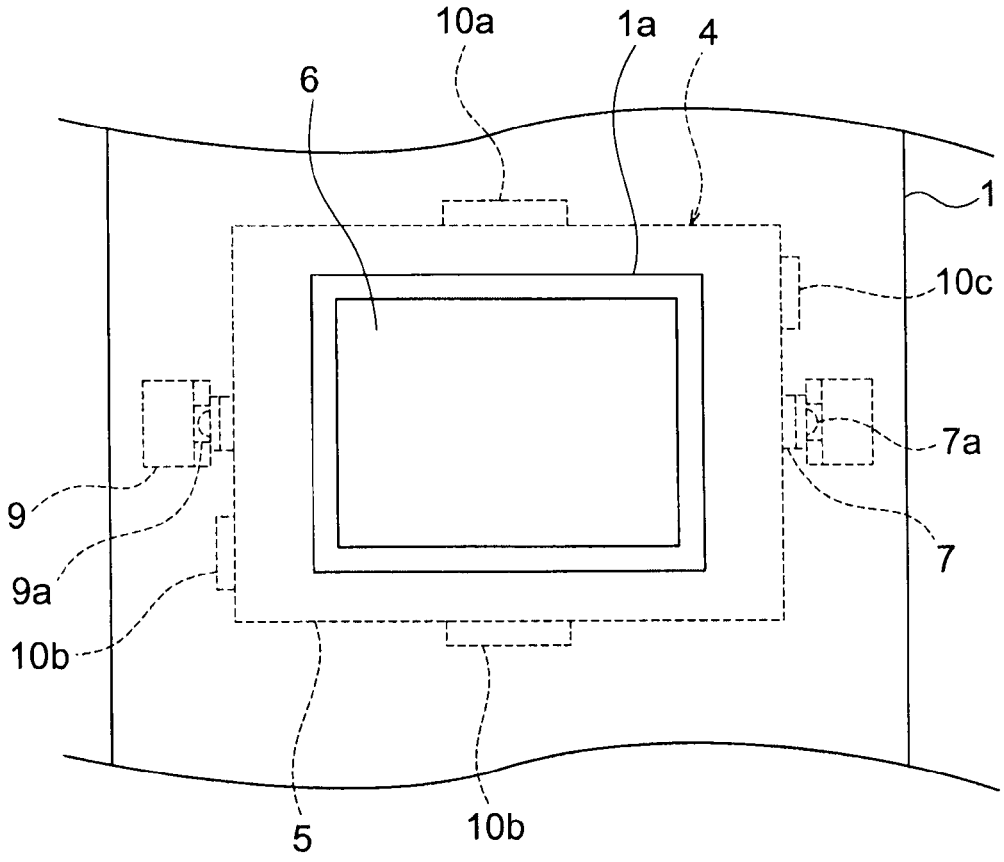
FIG. 7 is a front view illustrating the principal part of the operation panel device for the elevator, according to a third embodiment of the present invention.

Next, FIG. 7 is a front view illustrating the principal part of the operation panel device for the elevator, according to a third embodiment of the present invention. Although some of the components are shared by the retaining mechanism and the positioning mechanism in the first and second embodiments, the positioning mechanism and the retaining mechanism are independently provided in the third embodiment. Specifically, the positioning mechanism includes first to fourth positioning projections 10*a* to 10*d* which are provided on the back surface of the faceplate 1 so as to respectively abut against upper, lower, left, and right side surfaces of the switch main body 5.

In addition, the retaining mechanism also includes a pair of retaining members 9 fixed onto the back surface of the faceplate 1, each being provided with a fitting hole 9*a* serving as a locking portion, and the elastic members 7, each being provided with the retaining projection 7*a*. The remaining configuration is the same as that of the first embodiment.

As described above, even when the positioning mechanism and the retaining mechanism are provided independently of each other, the outer frame, which is visible from the surface side of the faceplate 1, is not required to be provided around the press portion 6. Moreover, the mounting of the push-button switch 4 onto the faceplate 1 can be facilitated. Further, the thickness of the operation panel device can be reduced.

Fourth Embodiment

Figure 8:
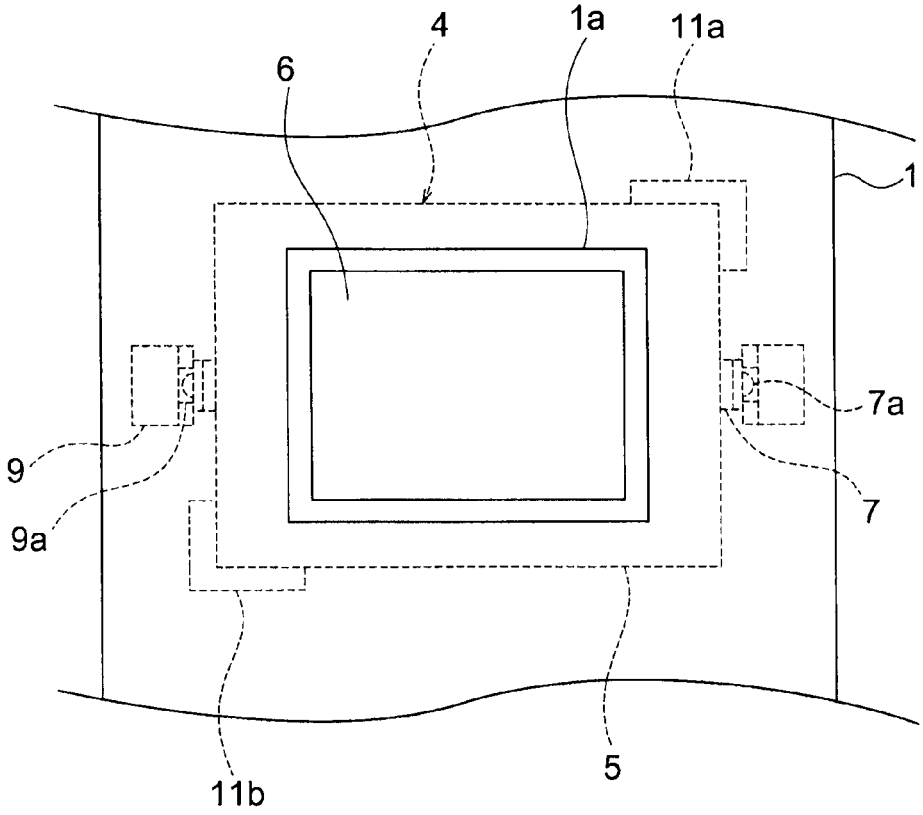
FIG. 8 is a front view illustrating the principal part of the operation panel device for the elevator, according to a fourth embodiment of the present invention.

Next, FIG. 8 is a front view illustrating the principal part of the operation panel device for the elevator, according to a fourth embodiment of the present invention. In the drawing, the positioning mechanism includes a pair of L-shaped positioning projections 11*a* and 11*b* provided on the back surface of the faceplate 1, each abutting against two adjacent side surfaces at each of a pair of corners of the switch main body 5, which are diagonally opposed to each other. The remaining configuration is the same as that of the third embodiment.

According to the configuration described above, the number of positioning projections 11*a* and 11*b* is reduced as compared with that of the third embodiment. As a result, the structure can be simplified.

Note that, the elastic members 7 may be integrally formed with the side surfaces of the switch main body 5. Similarly, the slit-forming members 3 or 8 maybe integrally formed with the retaining members 2. For example, in the case where each of the side surfaces of the switch main body 5 and the retaining members 2 is formed of a sheet metal member, the elastic members 7 and the slit-forming members 3 or 8 can be formed by sheet-metal press working. As a result, the number of components can be reduced to lower the cost.

Although the retaining members 2 are provided on the right and left sides of the opening portion 1*a* in the above-mentioned examples, the retaining members may also be provided on upper and lower sides of the opening portion. In this case, the elastic members 7 are suitably provided respectively on an upper surface and a lower surface of the switch main body 5.

Further, although the retaining members 2 are provided on the faceplate 1 and the elastic members 7 are provided to the switch main body 5 in the above-mentioned examples , the members to be provided respectively on the faceplate and to the switch main body may be interchanged.

Further, although the retaining mechanism in which the retention projections 7*a* are fitted into the fitting holes 2*a* or 9*a* is used in the above-mentioned examples, the retaining mechanism is not limited thereto. For example, a structure for locking a hook to the locking portion may also be used.

In addition, although the flat-spring type elastic members 7 are described in the above-mentioned examples, a coil spring for biasing a locking member to be locked to the locking portion toward the locking portion or the like may also be used.

Further, the switch is not limited to the push-button switch 4. For example, a touch switch operated by a touch of a user or the like may also be used.

The invention claimed is:

1. An operation panel device for an elevator, comprising:
a faceplate having an opening portion; and
a switch including:
a switch main body mounted onto the faceplate;
an operation portion provided to the switch main body, the operation portion being exposed on a surface side of the faceplate through the opening portion; and
a retaining mechanism for retaining the switch main body in a predetermined mounting position on the faceplate and provided between a side surface of the switch main body and a back surface of the faceplate,
wherein the retaining mechanism includes an elastic member having a base portion mounted to the switch main body, and a projecting portion projecting from the base portion and extending toward the faceplate when the switch is mounted to the faceplate, for allowing the switch main body to be moved to the mounting position by elastic deformation and for being restored to an original state to prevent the switch main body from moving from the mounting position.

2. The operation panel device for an elevator, according to claim 1, wherein:
the elastic member is provided on the side surface of the switch main body; and
on the back surface of the faceplate, a retaining member to which the elastic member is engaged is provided.

3. The operation panel device for an elevator, according to claim 2, wherein:
any one of the elastic member and the retaining member is provided with a retaining projection; and
another of the elastic member and the retaining member is provided with a locking portion to which the retaining projection is locked.

4. The operation panel device for an elevator, according to claim 1, wherein, between the side surface of the switch main body and the back surface of the faceplate, a positioning mechanism for guiding the switch main body in a direction perpendicular to the back surface of the faceplate and for positioning the switch main body for mounting the switch main body onto the faceplate is provided.

5. The operation panel device for an elevator, according to claim 4, wherein the positioning mechanism includes: a plurality of insertion members provided on any of the side surfaces of the switch main body and the back surface of the faceplate; and a plurality of slit-forming members provided on another of the side surfaces of the switch main body and the back surface of the faceplate, the slit-forming members being for forming slits into which the corresponding insertion members are respectively inserted.

6. The operation panel device for an elevator, according to claim 5, wherein the elastic member also serves as the insertion member.

7. The operation panel device for an elevator, according to claim 4, wherein the positioning mechanism includes a plurality of positioning projections provided on the back surface of the faceplate, the positioning projections respectively abutting against the side surfaces of the switch main body.

8. An operation panel device for an elevator, comprising:
a faceplate having an opening portion and a retaining member projecting from the back side thereof; and
a switch including:
a switch main body mountable onto the faceplate;
an operation portion provided to the switch main body, the operation portion being exposed on a surface side of the faceplate through the opening portion; and
a retaining mechanism for retaining the switch main body in a predetermined mounting position on the faceplate and provided between a side surface of the switch main body and a back surface of the faceplate,
wherein the retaining mechanism includes elastic members each having a base portion mounted to the switch main body, and a projecting portion projecting parallel to the projecting direction of the retaining member and extending from the base portion toward the faceplate when the switch is mounted to the faceplate, for allowing the switch main body to be moved to the mounting position by elastic deformation and for being restored to an original state to prevent the switch main body from moving from the mounting position, and
wherein the projecting portion of each elastic member is in surface contact with the retaining member when the switch main body is in the mounting position.

* * * * *